US006776570B1

(12) United States Patent
Thobe et al.

(10) Patent No.: US 6,776,570 B1
(45) Date of Patent: Aug. 17, 2004

(54) REFUSE RECEPTACLE HAVING A CHARGING HOPPER AND MOVING FLOOR AND METHOD THEREFOR

(76) Inventors: Michael Thobe, 909 Waverly Road, Glen Waverly 3150, Melbourne, Victoria (AU), 3150; Helmut Otto Bruno Thobe, 909 Waverly Road, Glen Waverly 3150, Melbourne (AU), 3150

( * ) Notice: Subject to any disclaimer, the term of this patent is extended or adjusted under 35 U.S.C. 154(b) by 0 days.

(21) Appl. No.: 10/430,625

(22) Filed: May 6, 2003

(51) Int. Cl.[7] ..... B30B 1/00
(52) U.S. Cl. ..... 414/525.2; 414/510; 414/517
(58) Field of Search ..... 414/510, 511, 414/517, 528, 525.2, 525.5, 525.3, 523, 525.53; 198/750.1, 750.2, 750.3, 750.4

(56) References Cited

U.S. PATENT DOCUMENTS 3,578,186 A * 5/1971 Thomas ..... 414/510
4,057,154 A * 11/1977 Neufeldt ..... 414/525.2
4,144,963 A * 3/1979 Hallstrom ..... 198/750.3
4,990,048 A * 2/1991 Foster ..... 198/750.2
5,067,868 A * 11/1991 Boda ..... 414/510
5,324,161 A * 6/1994 Thobe ..... 414/525.2
5,584,642 A * 12/1996 Huntoon ..... 414/525.2

* cited by examiner

*Primary Examiner*—James R. Bidwell
(74) *Attorney, Agent, or Firm*—Jeffrey D. Moy; Harry M. Weiss; Weiss, Moy & Harris, P.C.

(57) ABSTRACT

A material handling apparatus comprising a charging hopper having an upper first opening through which material can be loaded into the charging hopper and a lower second opening through which material can be discharged from the charging hopper. The apparatus includes a control member having a work head having one or more sections which is mounted for movement within the charging hopper about a pivot axis which extends generally laterally with respect to the normal upright operative position of the apparatus. The control member is pivotally movable about the pivot axis between a first position in which the work head is spaced from and disposed above the second opening, and a second position in which the work head is adjacent or within the second opening. The control member has a plurality of arms for pivotally mounting control member. A pivot bar is coupled to the mounting arms for maintaining stability between the mounting arms and to ensure proper movement of the control member.

13 Claims, 9 Drawing Sheets

REFUSE RECEPTACLE HAVING A CHARGING HOPPER AND MOVING FLOOR AND METHOD THEREFOR

RELATED APPLICATIONS

This patent application is related to U.S. Pat. No. 5,324,161 entitled "REFUSE RECEPTACLE CHARGING HOPPER" issued on Jun. 28, 1994 in the name of Helmut B. Thobe. The above patent is hereby incorporated into the present application.

BACKGROUND OF THE INVENTION

1. Field of the Invention

This invention relates generally to a refuse receptacle and, more specifically, to a refuse receptacle having an improved charging hopper for compacting the refuse and a walking floor to remove the refused from the receptacle.

2. Description of the Prior Art

Refuse receptacles have been in use for a long time. One type of refuse handling apparatus includes a loading mechanism which feeds refuse to a holding receptacle whenever the refuse is compressed or compacted by a ram or press which forms part of the loading mechanism. Such apparatus is usually mounted on a truck or like vehicle and can be used in the collection of domestic refuse. Examples of such devices are described in U.S. Pat. Nos. 3,874,529, 3,881,613, 4,050,594, 4,298,306, 4,637,306 and 4,786,228. Devices of this type suffer from the disadvantage that they are generally complicated and, as a result, expensive and difficult to maintain.

U.S. Patent 5,324,161 discloses a refuse receptacle charging hopper. The charging hopper helps to overcome many of the disadvantages of the prior art. However, debris has a tendency to become stuck in the arms and cylinders of the control member. Furthermore, the control member is only designed to work in a single compartment refuse receptacle.

Therefore, a need existed to provide an improved refuse receptacle. The improved refuse receptacle must be able to overcome the problems associated with prior art refuse receptacle. The refuse receptacle must be able to keep debris from becoming stuck in the arms and cylinders of the control member. The refuse receptacle must further have a control member which may be used in a multiple compartment refuse receptacle. The improved refuse receptacle must further be able to easily unload the refuse once the refuse is collected.

SUMMARY OF THE INVENTION

In accordance with one embodiment of the present invention, it is an object of the present invention to provide an improved refuse receptacle.

It is another object of the present invention to provide an improved refuse receptacle which must be able to overcome the problems associated with prior art refuse receptacle.

It is still another object of the present invention to provide an improved refuse receptacle that is able to keep debris from becoming stuck in the arms and cylinders of the control member.

It is another object of the present invention to provide an improved refuse receptacle that has a control member which may be used in a multiple compartment refuse receptacle.

It is yet another object of the present invention to provide an improved refuse receptacle that is able to easily unload the refuse once the refuse is collected.

BRIEF DESCRIPTION OF THE EMBODIMENTS

In accordance with one embodiment of the present invention, a refuse handling apparatus having a collection receptacle is disclosed. The collection receptacle on the refuse handling apparatus has a charging hopper having a first opening for loading material into the charging hopper, a second opening through which material can be discharged from the charging hopper, the second opening being disposed below the first opening when the apparatus is in use. The charging hopper has a curved guide surface therein which extends between the first and second openings so as to form a slide for directing material towards the second opening. A control member is provided and has a work head which is mounted for movement within the charging hopper about a pivot axis which extends generally horizontally when the apparatus is in use. The control member is pivotally movable about the pivot axis between a first position in which the work head is spaced from and disposed above the second opening, and a second position in which the work head is adjacent or within the second opening. The curved guide surface of the hopper is generally complementary to the arc of movement of the lower most part of the work head between the first and second positions. The work head is disposed adjacent the guide surface and in close proximity thereto during movement between the first and second positions. The control member has a top surface of the work head, and a lower surface curved to substantially the same arc as the guide surface. The top surface is shaped to act as a sloping surface when the work head is in the first position to guide material towards the second opening, and wherein the top surface is at all times exposed to the hopper and the first opening so that material may enter into the first opening and the hopper irrespective of the position of the control member at and between the first position and the second position. The control member further has a block having a front wall, the top surface, the lower surface, and side walls, the front wall being arranged to push the material through the second opening and, to compact the material within the receptacle. Each of the side walls has a section which is complementary to the guide surface, the section of the side walls and the lower surface of the control member being adjacent to the guide surface of the charging hopper whereby when the control member moves from the second position to the first position the leading edge of the control member defined by the end of the top surface most remote from the front wall and the lower surface will tend to scrape material off the guide surface onto the top surface. Mounting arms are provided which have the work head operatively connected to one end thereof, the other ends of the mounting arms being mounted for pivotal movement about the pivot axis. A pivot tube is coupled to the mounting arms. The pivot tube is used for maintaining stability between the mounting arms and to ensure proper movement of the control member.

The foregoing and other objects, features, and advantages of the invention will be apparent from the following, more particular, description of the preferred embodiments of the invention, as illustrated in the accompanying drawings.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings.

DETAILED DESCRIPTION OF THE PREFERRED EMBODIMENT

Figure 1:
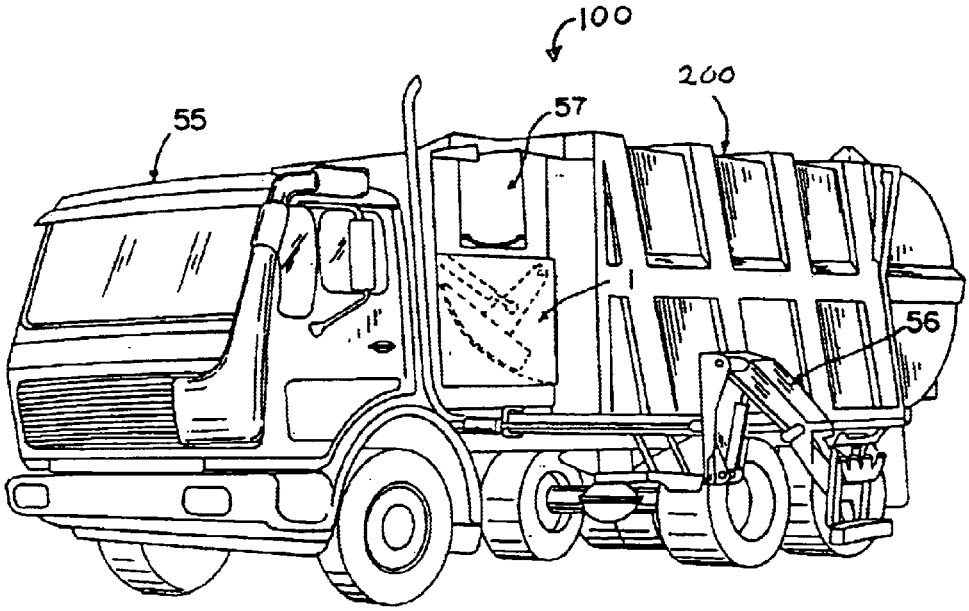
FIG. 1 is an elevated perspective of the improved refuse receptacle of the present invention.

Referring to the figures, an improved refuse receptacle 100 (hereinafter receptacle 100) is shown. The receptacle 100 overcomes many of the problems associated with prior art receptacles. The receptacle 100 is designed to keep debris from becoming stuck in the arms 18 and drive means 27 of the control member 10. The receptacle 100 is further able to have a control member 10 which may be used in a multiple compartment refuse receptacle. The improved receptacle 100 is also able to easily unload the refuse once the refuse is collected.

Referring to FIG. 1, the receptacle 100 is shown. The receptacle 100 can be a standard garbage truck which has been modified, a stationary, or a break away compactor. In the Figures, a standard garbage truck is shown implementing the present invention. However, this should not be seen as to limit the scope of the present invention.

The receptacle 100 has a collection receptacle 200 which is coupled to a frame of the receptacle 100. The collection receptacle 200 is used to store the garbage which is collected. A loading arm 56 is also coupled to the receptacle 100. The loading arm 56 is used to pick up refuse bins and discharge the contents through a chute 57 to the collection receptacle 200.

The collection receptacle 200 has a charging hopper 3. The charging hopper 3 has a side wall 5 with a first opening 6 in its top and a second opening 7 in a lower region of the side wall 5. The charging hopper 3 further includes a base wall 8 having a curved surface 9, which forms a slide directed from the first opening 6 towards the second opening 7. In the particular application shown in FIG. 1, material from chute 57 is directed through the first opening 6 and material is passed through the second opening 7 into the collection receptacle 200.

The charging hopper 3 further includes a control member 10 having a work head 12 disposed within the charging hopper 3. The control member 10 being mounted for movement about a pivot axis 20 which extends generally horizontally as shown. The work head 12 moves in an arc about the pivot axis 20 between a first or raised position in which the work head 12 is spaced from the second opening 7 and a second or lowered position in which the work head 12 is adjacent or within the second opening.

The work head 12, as shown is in the form of a wedge having a front wall 14, a top wall 15 and side walls 16. In operation the front wall 14 is arranged to push the material in the charging hopper 3 through the second opening 7 and where necessary compact the material within the collection receptacle 200.

Figure 2:
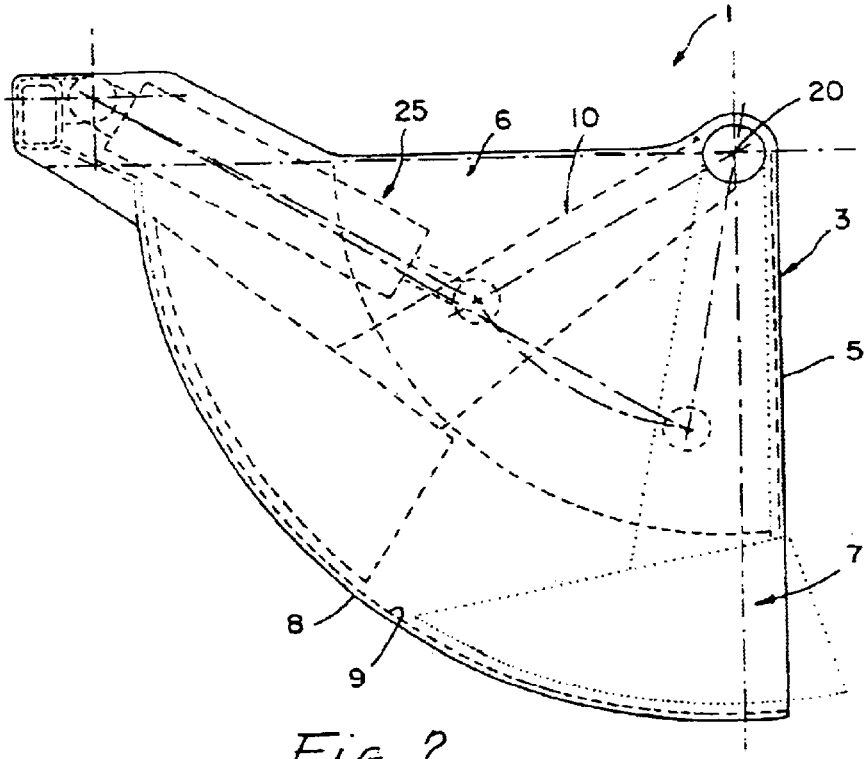
FIG. 2 is a side view of the charging hopper used in the container section of the improved refuse receptacle.
Figure 3:
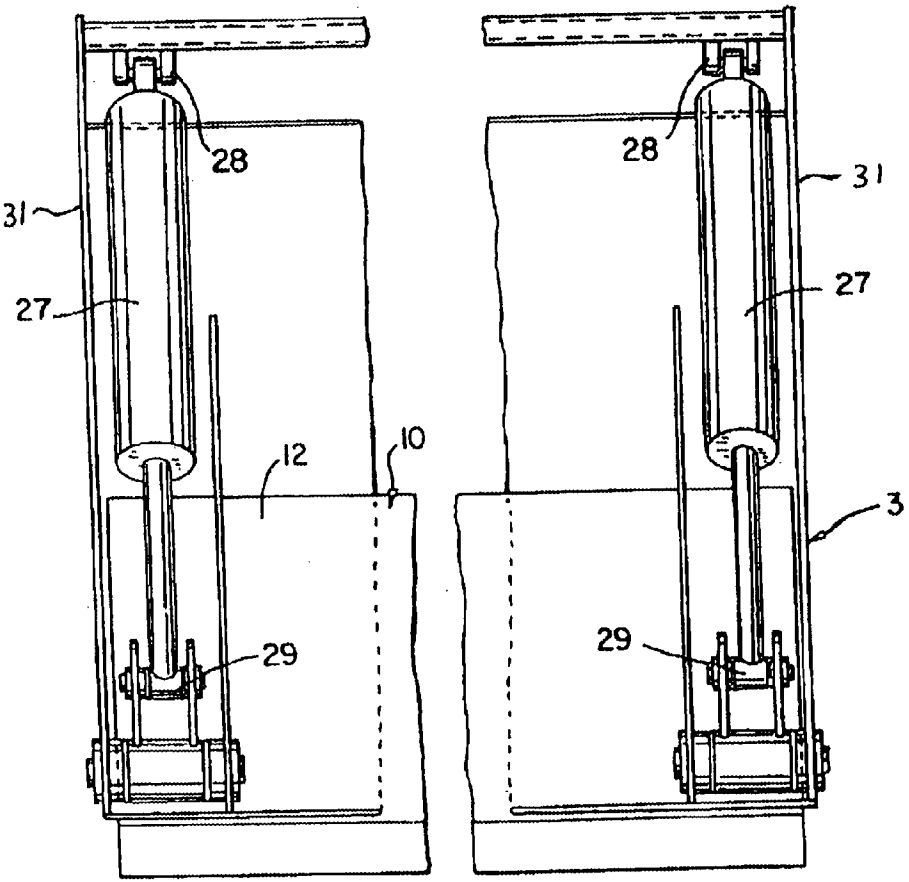
FIG. 3 is a plan view of the charging hopper used in the container section of the improved refuse receptacle.
Figure 4:
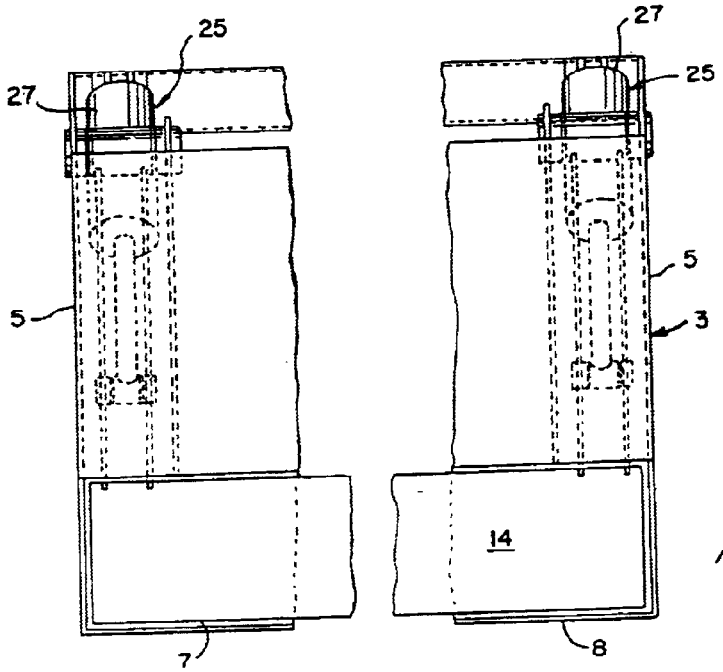
FIG. 4 is an end elevated view of the drive means used in the charging hopper of the improved refuse receptacle.
Figure 5:
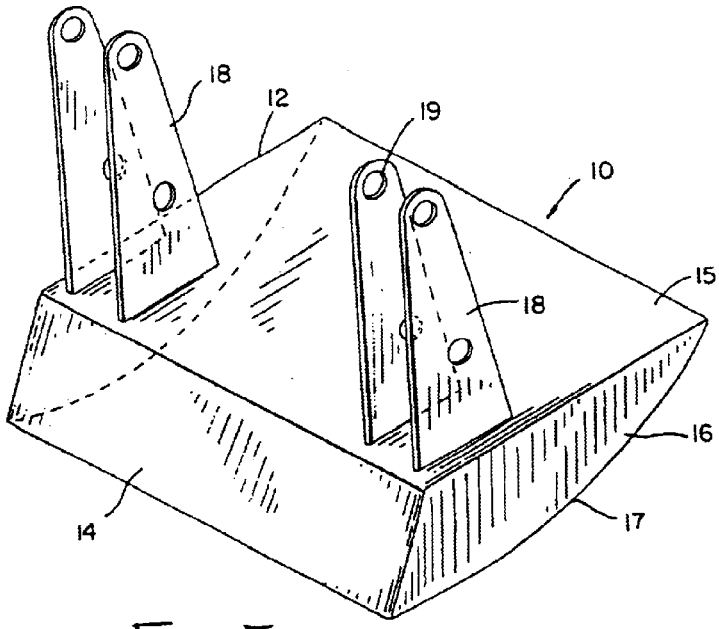
FIG. 5 is a schematic perspective view of a control member used in the charging hopper of the improved refuse receptacle.
Figure 6A:
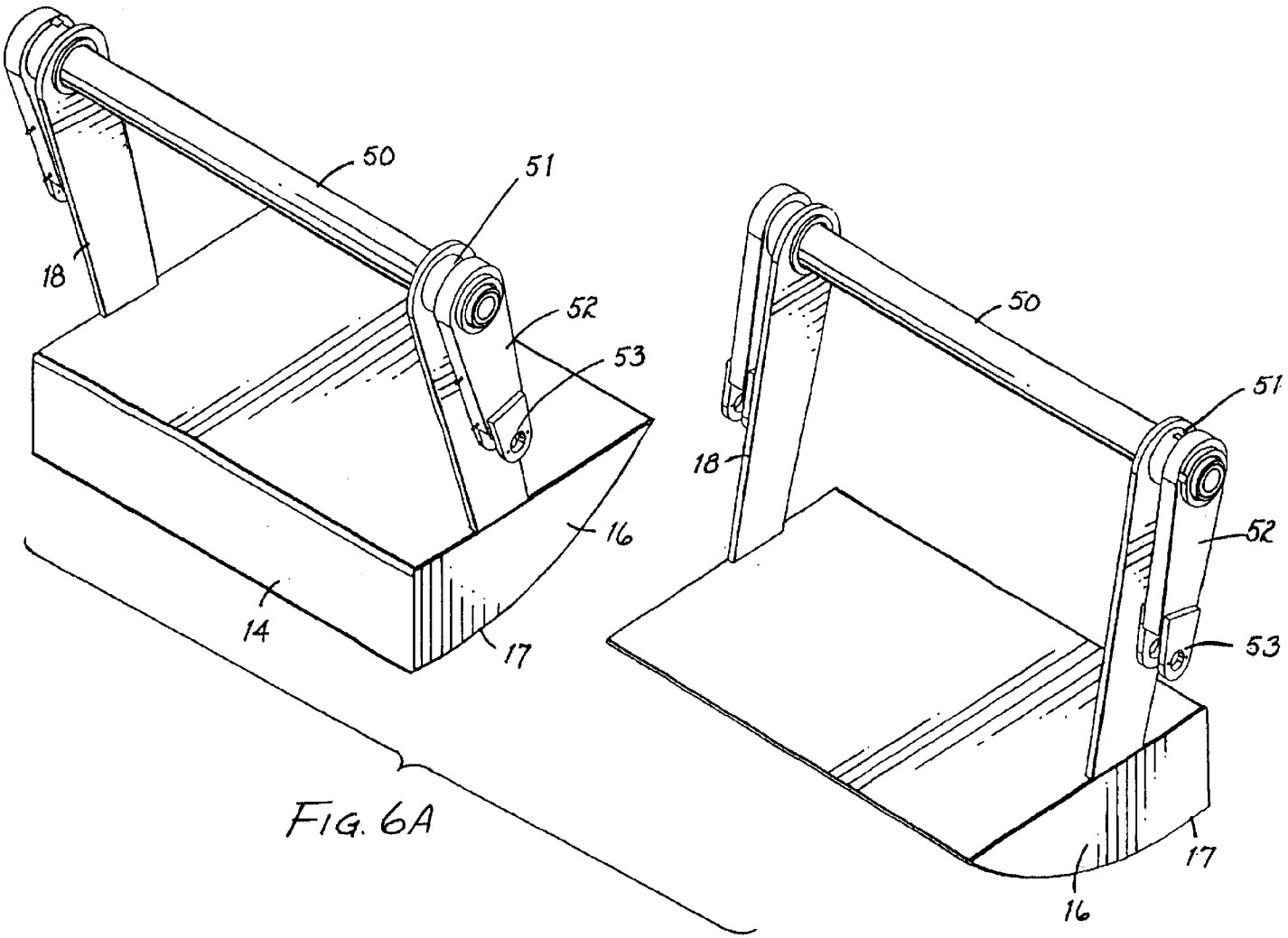
FIG. 6A is an elevated front and rear perspective view of the control member used in the improved refuse receptacle of the present invention.
Figure 6B:
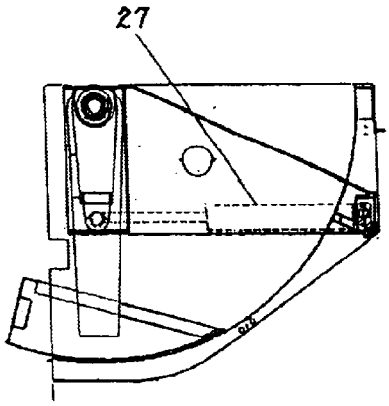
FIG. 6B is a side view of the control member used in the improved refuse receptacle of the present invention, the opposite side being a mirror image thereof.
Figure 6C:
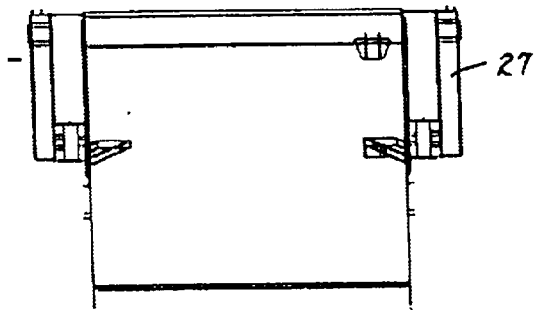
FIG. 6C is a top view of the control member used in the improved refuse receptacle of the present invention.
Figure 6D:
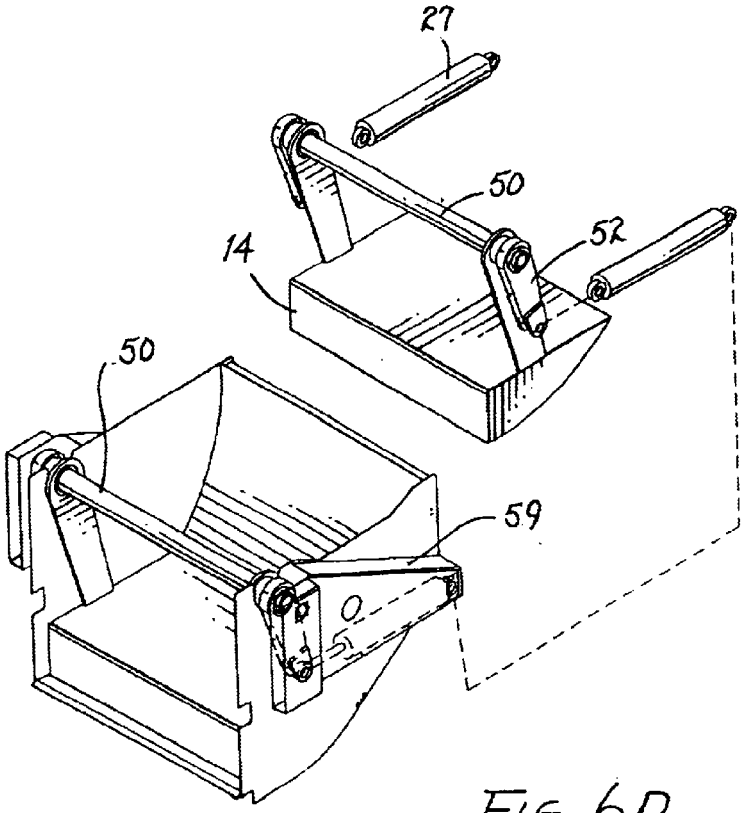
FIG. 6D is an exploded view of the control member used in the improved refuse receptacle of the present invention.

The side walls 16 of the work head 12 each have a curved lower edge 17 which is complementary to the curved guide surface 9 of the charging hopper 3, the curved lower edges 17 of the side wall of the work head 12 being adjacent to the curved guide surface of the charging hopper 3. As best seen in FIG. 2 the top wall 15 and side walls 16 converge towards one another in the direction of the trailing edge of work head 12. Thus when in the raised position as shown in FIG. 2, the work head 12 does not interfere with the opening 6 of the charging hopper 3.

The control member 10 further includes a pair of mounting arms 18 which have the work head 12 operatively connected to one thereof, the other ends being mounted for pivotal movement about the pivot axis 20 in suitable bearings 19. The mounting arms 18 are disposed at the sides of the work head so as to ensure a minimum of interference at the first opening 6.

The top wall 15 of the work head 12 forms a cover above the second opening 7 when the control member is in the lowered or second position so that material being loaded into the charging hopper 3 through opening 6 will not interfere with the material being discharged through the second opening. As best seen in FIG. 2, when the work head 12 is in the first or raised position, the top wall is positioned such that it is adjacent the side wall 31 of the charging hopper 3.

Drive means 25 causes movement of the control member 10 between the first and second positions. The drive means 25 is in the form of hydraulic pistons/cylinder assemblies 27 operatively interconnected between the mounting arms 18 and the charging hopper 3. The piston/cylinder assemblies 27 are mounted on pivot pins 28 and 29 on the charging hopper 3 and the mounting arms 18 respectively.

As may be seen more clearly in FIGS. 6A–6D, the control member 10 has a pivot tube 50. The pivot tube 50 has a mounting collar 51 connected to each end of the pivot tube 50. The pivot tube 50 via the mounting collars 51 is coupled to both mounting arms 18 and the cylindrical crank arms 52. Each mounting arm 18 and cylinder crank arm 52 has an opening at the top thereof. The pivot tube 50 extends through the openings and is coupled to a first mounting collar 51. The mounting collar 51 extends through the openings and is coupled to mounting arms 18 and the cylinder crank arms 52. The pivot tube 50 is then coupled to the second mounting collar 51 where the second mounting arm 18 and the second cylinder crank arm 52 are coupled to. The drive means 25 are then connected to the cylinder arms 52 via the cylinder crank arms ears 53. The pivot tube 50 helps to maintain stability between mounting arms 18 and the cylinder crank arms 52. The pivot tube 50 and the cylinder crank arms 52 also helps one to mount the drive means 25 outside of the charging hopper 3. This allows for simple service and maintenance and longer life of the receptacle 100.

If trash blocks the driving means 25, the control member 10 will be unable to move. Thus, a protective cover 59 is placed over the driving means 25. The protective cover 59 is placed over both driving means 25 and is coupled to the control member 10. The protective cover 59 is designed to allow the control member 10 to move freely but prevent garbage from blocking and jamming the driving means 25. The protective cover 59 can be made out of any type of material. In general, a light weight metal is used. However, this should not be seen as to limit the scope of the present invention.

Figure 7A:
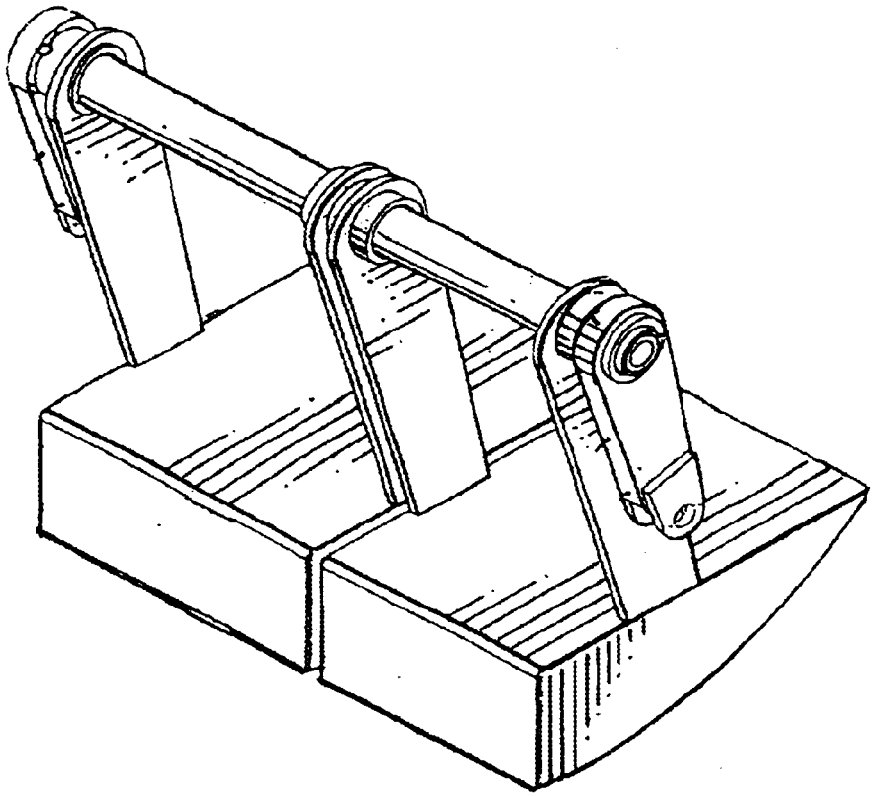
FIG. 7A is an elevated perspective view of a second embodiment of the control member used in the improved refuse receptacle of the present invention.

Referring now to FIG. 7A, another embodiment of the control member 10 is shown. In this embodiment, the control member 10 is a two piece control member 10. A two piece control member 10 is used in a receptacle 100 which collects different types of refuse. For example, a receptacle 100 that collects both recyclable and non-recyclable items. In this case, the collection receptacle 200 will be divided into two compartments: one for recyclable items and another for non-recyclable items. The charging hopper 3 is similar as described above. The main difference is that the charging hopper 3 is designed to have two separate openings for receiving the different types of garbage. The control member 10 is also divided into two components to move and compact the items in each compartment of the collection receptacle 200. The control member 10 is similar to that described above. The main difference is that the working head 12 is divided into two sections. Additional mounting arms 18 are positioned between each section of the working head 12 to provided additional support. The pivot tube 50 runs through openings in each of the mounting arms and is coupled to the drive means 25. The drive means 25 may be configured to drive both sections of the control member 10 together or individually. It should be noted that the control member may be divided into more than two sections. The showing of two sections should not be seen as to limit the scope of the present invention.

Figure 7B:
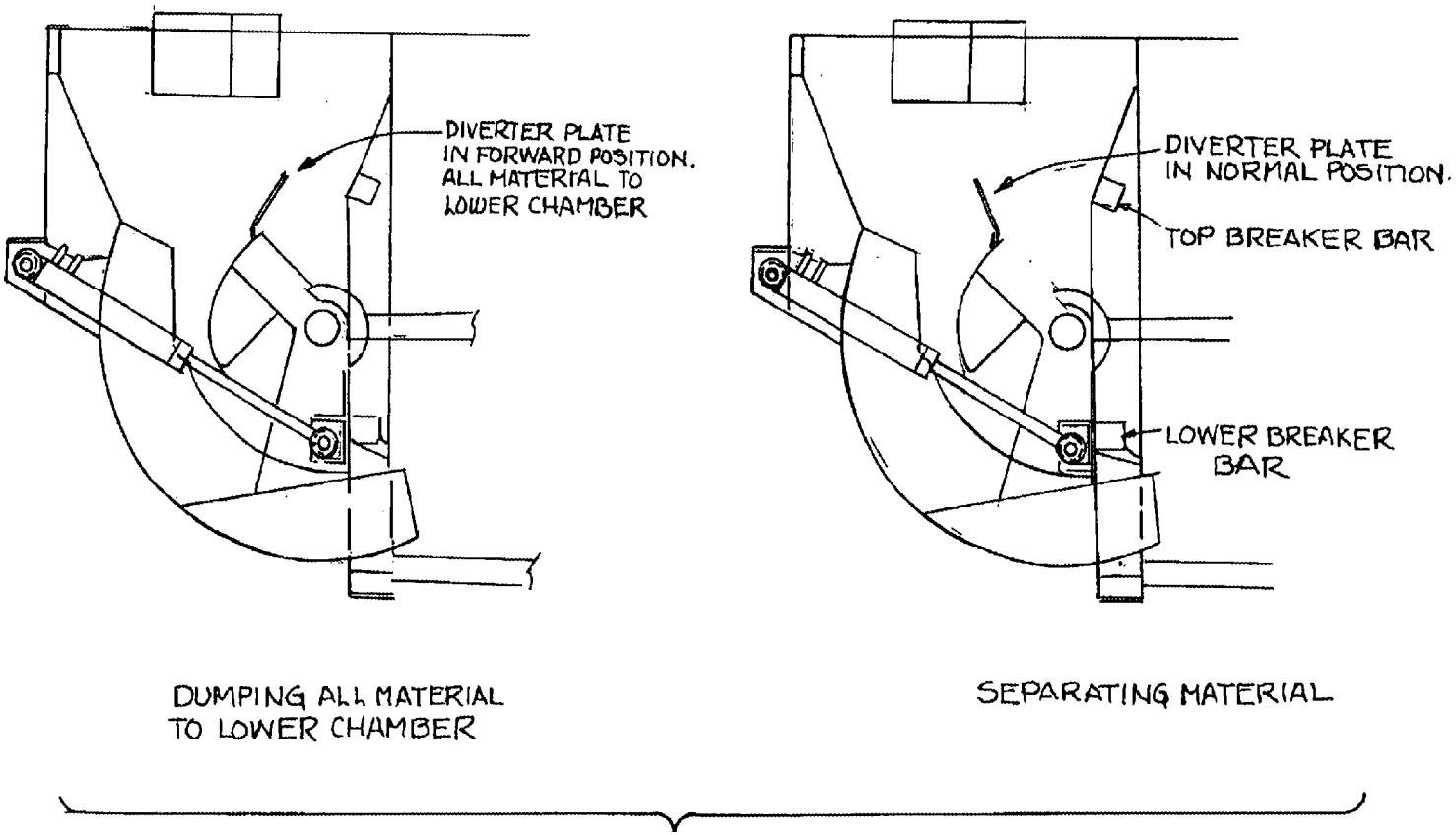
FIG. 7B is an elevated perspective view of another embodiment of the control member used in the improved refuse receptacle of the present invention.
Figure 8:
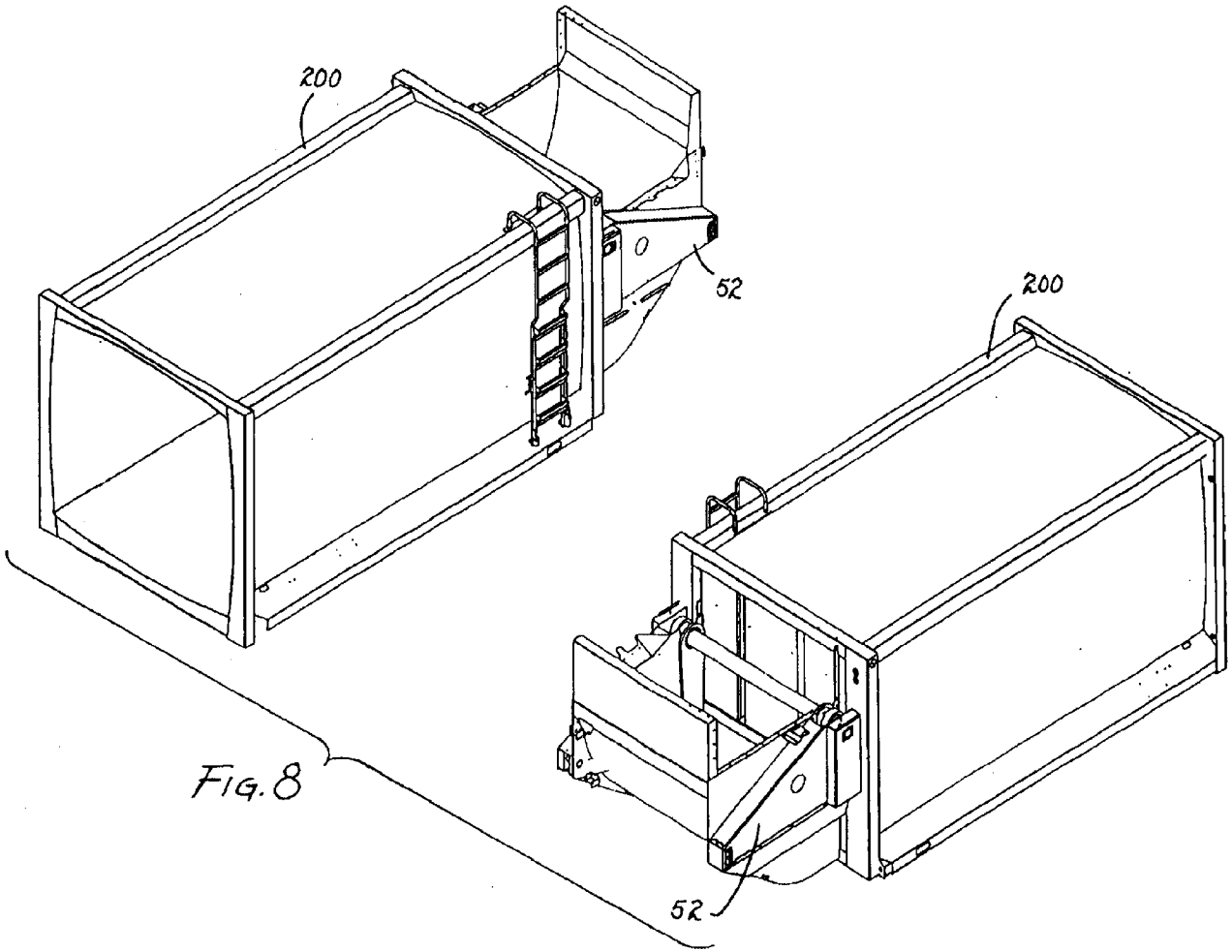
FIG. 8 is an elevated front and rear perspective view of the collection receptacle used in the improved refuse receptacle of the present invention.

Referring to FIG. 7B, another embodiment of the control member 10 is shown. In this embodiment, the control member 10 is a two piece control member 10 and similar to that shown and described above. The main difference is that the working head 12 which is divided into two sections are positioned in a vertical manner such that one head is positioned above a second head. This is done so that while one head is compacting the refuse, the second head can be used to scrape material off of the collection receptacle.

Figure 9:
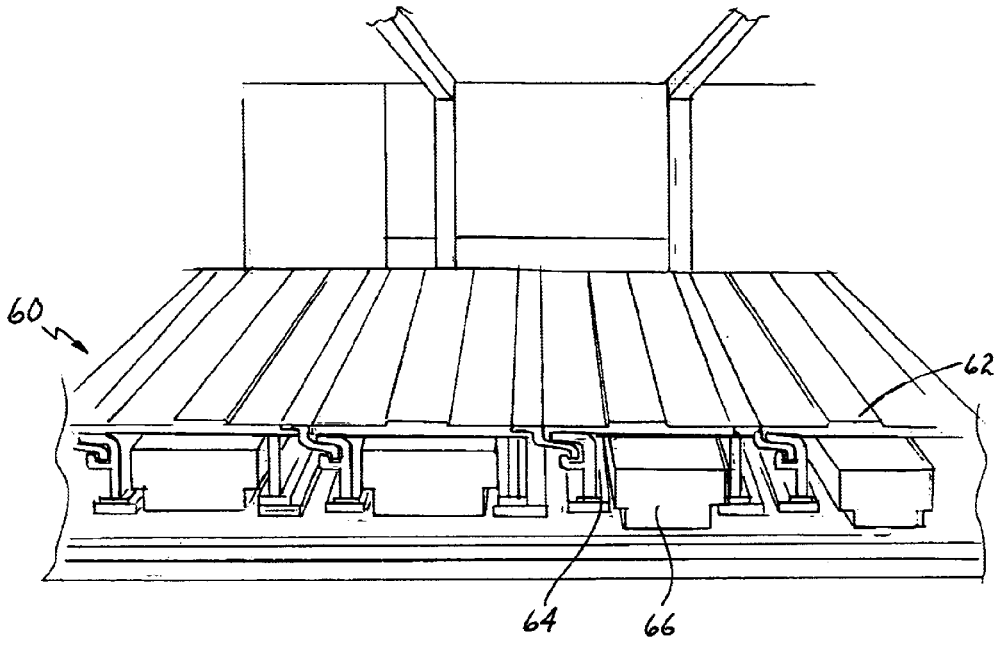
FIG. 9 is a rear view of the moving floor used in the improved refuse receptacle of the present invention.

In a prior art refuse receptacles, in order to empty the collection receptacle, one end of the collection receptacle is raised. The other end of the collection receptacle is opened so that the collected garbage can discharged from the collection receptacle. Referring to FIG. 9, an internal view of the collection receptacle 200 is shown. The collection receptacle 200 has a moving floor 60. The moving floor 60 will discard the garbage from the rear of the collection receptacle 200 without having the collection receptacle 200 having to be raised. The moving floor 60 has a plurality of floor boards 62. The floor boards 62 may be made out of any type of material. In general a light weight metal is used. However, this should not be seen as to limit the scope of the present invention. The floor board 62 is generally in the form of a hollow rectangular tubing having a channeling 64 formed there through. A plurality of wheel member 66 are mounted to each floor board and are located in the channeling 64. The wheel member 66 will allow the floor board to in a forward and reverse manner. When the floor boards 62 move in conjuction with one another, the garbage stored in the collection receptacle 200 will be moved and discarded out of the collection receptacle 200.

In operation, material such as refuse can be loaded into the charging hopper 3 through the first opening 6 thereof. With the control member 10 in the first or raised position the material falls onto the curved guide surface on the base of the charging hopper 3 and under the influence of gravity is directed towards the second opening 7 from where it passes into the holding receptacle 51.

Activation of the drive means 25 causes the control member 10 to move from the first position where the work head 12 is raised to the second position where it is disposed adjacent the second opening 7 and thereby forcing the material into the holding receptacle and when necessary compacting or compressing the material. As shown in FIG. 2, the arcuate length of the lower surface of control member 10 adjacent guide surface 9 is less than half the arcuate swing of the control member 10 between the first position and the second position.

In the second or lowered position the top wall 15 of the work head 12 forms a barrier over the second opening 7 thereby ensuring that any material deposited in the charging hopper 3 with the control member in the second position does not interfere with the compressing action of the work head. Further activation of the drive means causes the control member to return to the first position where the operation can be repeated.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A refuse handling apparatus having a collection receptacle, the collection receptacle comprising:

a charging hopper having a first opening for loading material into the charging hopper, a second opening through which material can be discharged from the charging hopper, the second opening being disposed below the first opening when the apparatus is in use, the charging hopper having a curved guide surface therein which extends between the first and second openings so as to form a slide for directing material towards the second opening;

a control member having a work head which is mounted for movement within the charging hopper about a pivot axis which extends generally horizontally when the apparatus is in use, the control member being pivotally movable about the pivot axis between a first position in which the work head is spaced from and disposed above the second opening, and a second position in which the work head is adjacent or within the second opening;

the curved guide surface of the hopper being generally complementary to the arc of movement of the lower most part of the work head between the first and second positions, the work head being disposed adjacent the guide surface and in close proximity thereto during movement between the first and second positions, the control member comprising a top surface of the work head, and a lower surface curved to substantially the same arc as the guide surface, the top surface being shaped to act as a sloping surface when the work head is in the first position to guide material towards the second opening, and wherein the top surface is at all times exposed to the hopper and the first opening, whereby material may enter into the first opening and the hopper irrespective of the position of the control member at and between the first position and the second position;

wherein the control member comprises:

a block having a front wall, the top surface, the lower surface, and side walls, the front wall being arranged to push the material through the second opening and, to compact the material within the receptacle, the side walls each having a section which is complementary to the guide surface, the section of the side walls and the lower surface of the control member being adjacent to the guide surface of the charging hopper, whereby when the control member moves from the second position to the first position the leading edge of the control member defined by the end of the top surface most remote from the front wall and the lower surface will tend to scrape material off the guide surface onto the top surface;

mounting arms which have the work head operatively connected to one end thereof, the other ends of the mounting arms being mounted for pivotal movement about the pivot axis; and a pivot tube coupled to the mounting arms for maintaining stability between the mounting arms and to ensure proper movement of the control member.

2. A refuse handling apparatus having a collection receptacle in accordance with claim 1, wherein the collection receptacle further comprises a moving floor for discarding the material that is collected.

3. A refuse handling apparatus having a collection receptacle in accordance with claim 2, wherein the moving floor comprises:

a plurality of floor boards coupled to a bottom surface of the collection receptacle; and a plurality of sliding blocks coupled to a bottom surface of the collection receptacle and engaging the plurality of floor boards for moving the plurality of floor boards in a forward and backwards direction for discarding the material that is collected.

4. A refuse handling apparatus having a collection receptacle in accordance with claim 3, wherein each of the plurality of floor boards comprises a metal tubing having a central channeling running the length thereof, the roller devices moveably engaged in the channeling for moving the plurality of floor boards in a forward and backwards direction for discarding the material that is collected.

5. A refuse handling apparatus having a collection receptacle in accordance with claim 1 wherein the work head comprises a first work head member and a second work head member for compacting material in separate compartments in the collection receptacle wherein the first work head member and the second work head member each have a pair of mounting arms for pivotal movement about the pivot axis.

6. A refuse handling apparatus having a collection receptacle in accordance with claim 1, further comprising:

drive means for causing movement of the control member and comprising at least one hydraulic piston and cylinder assembly operatively interconnected between the mounting arms and the charging hopper; and protective cover positioned over the drive means for preventing material from blocking and jamming the drive means.

7. A refuse handling apparatus having a collection receptacle in accordance with claim 1, wherein the top surface of the work head forms a cover above the second opening when the control member is in the second position so that material being loaded into the charging hopper through the first opening will not interfere with the material being discharged through the second opening, and when the work head is in the first position, the top surface is displaced in such a manner that it is adjacent one of the side walls of the hopper.

8. A refuse handling apparatus having a collection receptacle in accordance with claim 1, wherein the arcuate length of the lower surface of the control member adjacent the guide surface is less than half the arcuate swing of the control member between the first position and the second position.

9. A refuse handling apparatus having a collection receptacle in accordance with claim 1 wherein the work head comprises a plurality of work head members for compacting material in separate compartments in the collection receptacle wherein the plurality of work head members each have a pair of mounting arms for pivotal movement about the pivot axis.

10. A refuse handling apparatus having a collection receptacle in accordance with claim 1 wherein the work head comprises a first work head member and a second work head member, the first work head member is located on a different horizontal plane from the second work head member, wherein the first work head member and the second work head member each have a pair of mounting arms for pivotal movement about the pivot axis.

11. A refuse handling apparatus having a collection receptacle in accordance with claim 1, further comprising drive means for causing movement of the control member and comprising at least one hydraulic piston and cylinder assembly operatively interconnected between the mounting arms and the charging hopper, wherein the drive means are located outside of the charging hopper.

12. A refuse handling apparatus having a collection receptacle in accordance with claim 11, further comprising a protective cover positioned over the drive means for preventing material from blocking and jamming the drive means and for maintaining serviceability and safety of the refuse handling apparatus.

13. A refuse handling apparatus having a collection receptacle, the collection receptacle comprising:

compacting means for compacting refuse placed in the refuse handling apparatus; and a moving floor for discarding the refuse that is collected, wherein the moving floor comprises:

a plurality of floor boards coupled to a bottom surface of the collection receptacle; and a plurality of sliding blocks coupled to a bottom surface of the collection receptacle and engaging the plurality of floor boards for moving the plurality of floor boards in a forward and backwards direction for discarding the material that is collected;

wherein each of the plurality of floor boards comprises a metal tubing having a central channeling running a length thereof, roller devices moveably engaged in the channeling for moving the plurality of floor boards in a forward and backwards direction for discarding the material that is collected.

* * * * *